United States Patent [19]

Immordino

[11] 3,999,327

[45] Dec. 28, 1976

[54] BOX-PLAY MODULE

[75] Inventor: Vincent J. Immordino, Flushing, N.Y.

[73] Assignee: Display Originals, Inc., Long Island, N.Y.

[22] Filed: May 12, 1975

[21] Appl. No.: 576,304

[52] U.S. Cl. ..... 46/11; 46/25; 206/457; 206/509; 229/8

[51] Int. Cl.[2] ..... A63H 32/08; B65D 21/02

[58] Field of Search ..... 206/504, 499, 511, 509, 206/457; 229/8; 46/11, 25; 220/213, 23.6

[56] References Cited

UNITED STATES PATENTS

| | | | |
|---|---|---|---|
| 250,026 | 11/1881 | Whitelaw | 46/11 |
| 1,077,510 | 11/1913 | Culver | 220/213 |
| 2,565,823 | 8/1951 | Pool | 46/25 |

FOREIGN PATENTS OR APPLICATIONS

| | | | |
|---|---|---|---|
| 239,230 | 1/1946 | Switzerland | 46/25 |

*Primary Examiner*—Leonard Summer

[57] ABSTRACT

A generally-rectangular box adapted to store candy pieces and other small objects, the upper side wall of the box having a double-humped wave formation, and the lower side wall thereof having a complementary single-humped wave formation, whereby when the boxes are stacked one above the other in a dispenser unit, the boxes intermesh with each other. When the boxes are withdrawn from the dispenser unit and the candy pieces removed therefrom, they are usable as play modules, in that a pair of boxes placed in end-to-end relation may be intercoupled by a third box seated on and straddling the adjacent humps of the pair below. Moreover, because the boxes have an abstract animal-like form, they may be decorated to assume the appearance of zebras, lions, and other four-legged animals, thereby enhancing their play value.

5 Claims, 8 Drawing Figures

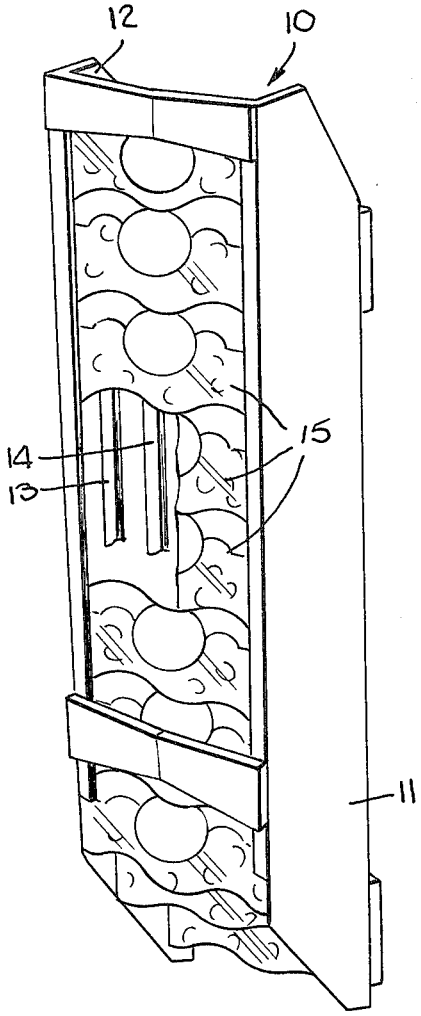
Fig. 1.
Fig. 2.
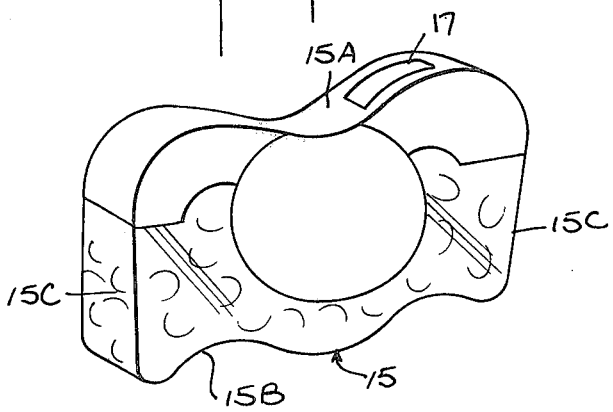
Fig. 3.
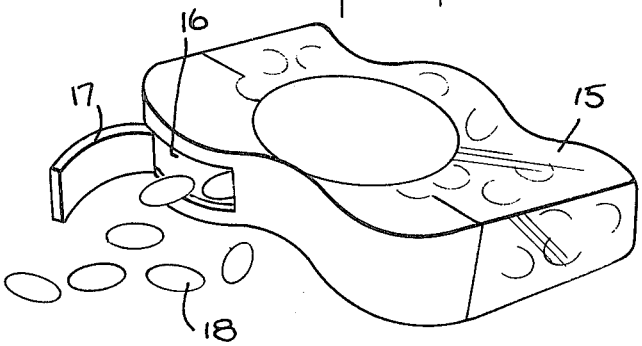
Fig. 7.
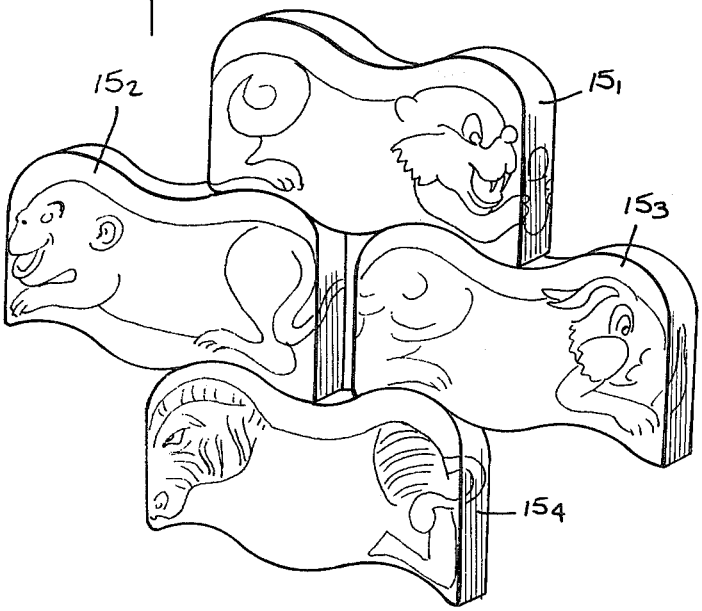
Fig. 8.
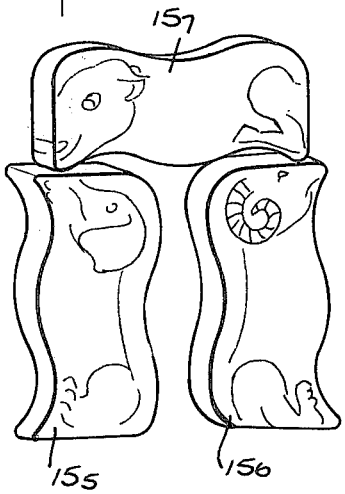

BOX-PLAY MODULE

BACKGROUND OF THE INVENTION

This invention relates generally to storage and dispenser units for goods contained in small boxes, and more particularly to boxes which lend themselves to efficient stacking in such units and which, when removed therefrom, are capable of functioning as play modules.

In the merchandising of candy and other products contained in small boxes, it is desirable that the product be attractively displayed in order to draw customers. The display on the counter of a single box is not feasible, for then the box is obscured by many other competing products. Moreover, when the product is advertised by a counter display card, but the supply of boxes is at another location, then should a customr seek to make a purchase, a sales person must leave the counter to find the supply and take a box therefrom, thereby complicating the transaction.

In order to provide dispensers which act both to store and display small containers of merchandise, it is known to provide units for this purpose which may be suspended from a wall or placed on the counter to attract customers and facilitate purchases. Thus in one widely-used dispenser for boxes containing candy mints, the unit is composed of a vertical array of inclined cells, each accommodating a single box.

In a copending patent application Ser. No. 532,858, filed Dec. 16, 1974 by Joseph P. Palamara, which issued as U.S. Pat. No. 3,957,174, May 18, 1976, there is disclosed a dispenser unit constituted by a frame having a pair of side walls from which ledges project that divide the frame into distinct compartments for accommodating the boxes to be stored, each compartment having a discharge opening permitting lateral withdrawal of boxes therefrom, one at a time. The advantage of a unit of the type disclosed in this copending application is that it is adapted to store a large number of relatively fragile boxes and to protect them against mishandling and damage.

The boxes presently used in existing types of dispensers, as well as those disclosed in the copending application, are fabricated of transparent plastic material and are rectangular in form, with straight ends and straight sides. Each box includes a hinged end hatch which, when opened, permits removal of the candy pieces. When these boxes are empty, they are discarded, for they have no further use. Since literally millions of such boxes are sold every year, the discarded boxes represent sheer waste. From the ecological standpoint, the boxes constitute still another form of environmenal pollution.

Briefly stated, these objects are attained in a generally rectangular box whose upper side wall has a double-humped wave formation and whose lower side wall has a complementary single-humped formation, such that when the boxes are stacked one above the other in a dispenser unit, the boxes intermesh neatly with each other to define a seemingly continuous slab, whereas when the boxes are withdrawn from the unit and emptied, they are usable as play modules, in that a pair of boxes placed in end-to-end relation may be intercoupled by a third box seated on and straddling the adjacent humps of the pair below to form play edifices. Because the boxes have an abstract animal-like configuration, they may be decorated to assume the appearance of various four-legged animals, thereby enhancing their play value.

OUTLINE OF DRAWINGS

FIG. 1 is a perspective view of a storage and dispensing unit containing boxes whose structural form is in accordance with the invention;

FIG. 2 shows, in perspective, an individual box;

FIG. 3 illustrates the same box with its hatch open;

FIG. 7 illustrates a play edifice formed by four intercoupled boxes; and

FIG. 8 illustrates an arch formed by three inter coupled boxes.

DESCRIPTION OF INVENTION

Figure 4:
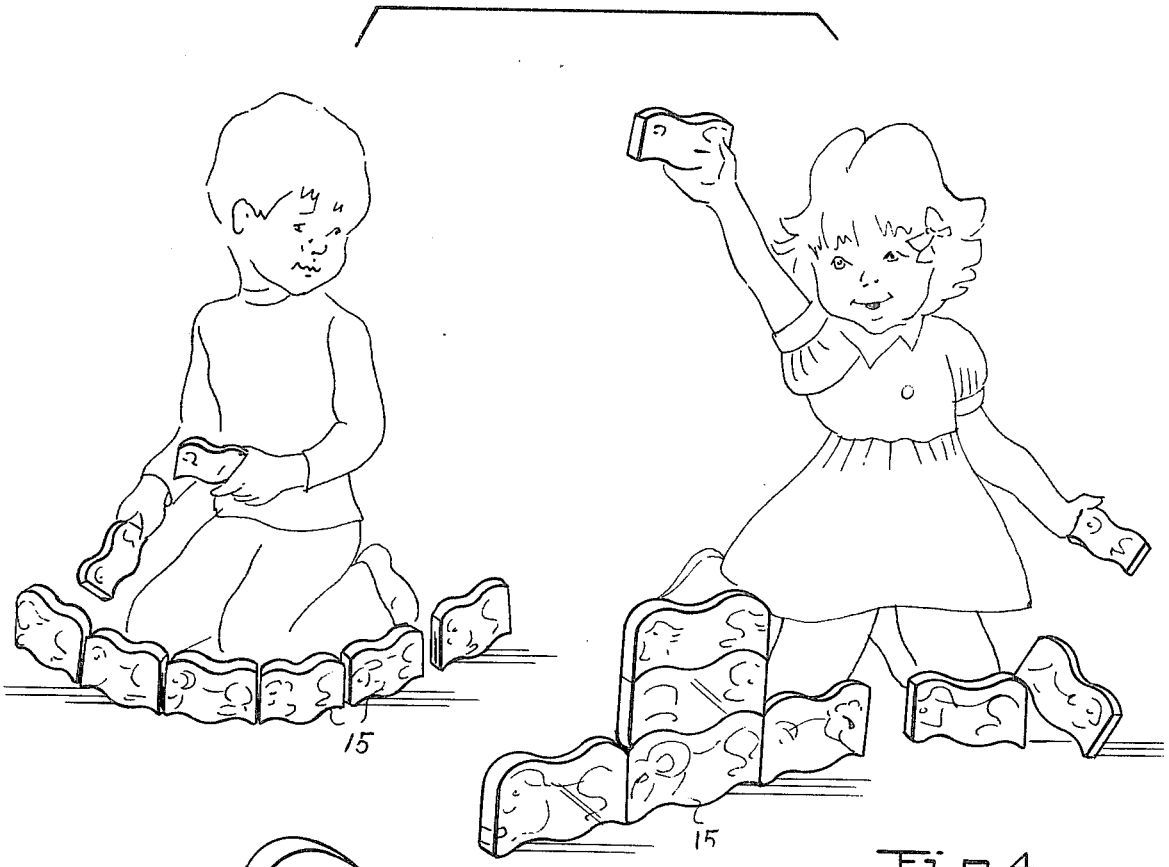
FIG. 4 shows how children may play with empty boxes.
Figure 5:
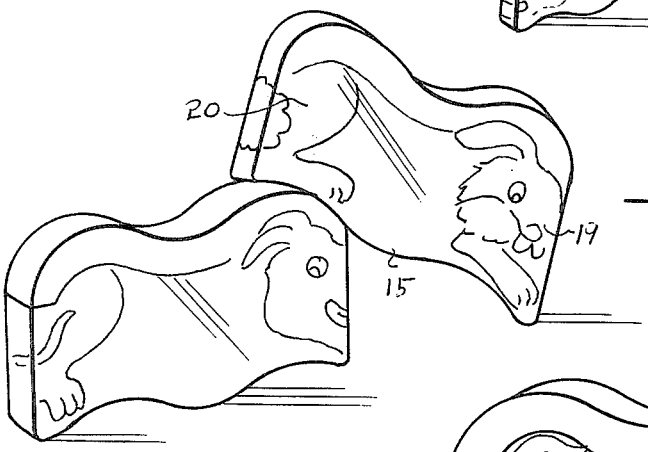
FIG. 5 illustrates two intercoupled boxes.

Referring now to FIG. 1, there is shown a storage and dispensing unit, generally designated by numeral 10, which is designed for vertical mounting on a wall or counter. In the case of a counter, a suitable stand (not shown) is provided to hold the unit erect.

The unit shown in FIG. 1 is of the type described in the copending patent application whose disclosure is incorporated herein by reference. The unit includes a pair of parallel side walls 11 and 12, the side walls having a series of ledges projecting inwardly therefrom, such as ledges 13 and 14, to divide the unit into parallel sub-channels or compartments for receiving boxes 15, which are stacked one above the other in the compartments. The lower ends of the ledges are provided with feet projecting laterally therefrom to prevent the boxes from sliding downwardly. The leading edges of the ledges are staggered to provide discharge openings for lateral removal of the boxes. The details of the unit are disclosed in the copending application.

Each box 15, as shown in FIG. 2, is generally rectangular in shape and is provided with a long upper side wall 15A having a double-humped wave formation, and a lower long side wall 15B having a complementary single-humped wave formation. The sinuous long side walls of the box merge with the straight ends 15C and 15B thereof, so that the four corners of the box are rounded rather than angled. The absence of sharp corners is important to the play module aspects of the box.

The upper side wall 15A, as shown in FIG. 3, is provided with a rectangular opening 16 adjacent one end of the box, which opening is covered by a hinged hatch 17 that conforms to the curvature of the side wall to avoid any discontinuity therein when the hatch is closed. Contained in this box are candy mints 18 or other small pieces which may be shaken from the box by opening the hatch.

Because the formation of the lower side wall complements that of the upper side wall, when boxes 15 are stacked one above the other in a sub-channel of the dispenser unit, as shown in FIG. 1, the boxes intermesh perfectly in that the two humps on the upper side wall of one box nest within the two troughs on the lower side wall of the box seated thereabove. Thus the stacked boxes present a seemingly continuous slab with no spaces therebetween.

When, however, the boxes are removed from the dispenser unit and emptied of their contents, they may be used as play modules, rather than discarded. Thus, as shown on the left side of FIG. 4, boxes 15 may be arranged into a train, in which the boxes are placed by the player in end-to-end relation. Or, as shown on the right side of this figure, some of the boxes deployed on the floor may be stacked one above the other.

Because each box has an abstract animal-like form, the box may be converted into a stylized effigy of a particular animal by means of printed sheets adhered to the ends of the box. Thus, as shown in FIG. 4, box 15 is given the appearance of a rabbit by means of a sheet 19 folded against one end of the box and adhered thereto, the sheet having printed thereon the fore part of a rabbit, and a sheet 20 folded against the opposite end of the box and adhered thereto, this sheet having printed thereon the rear part of the rabbit. The sheets are preferably in the form of transparent film material so as not to interfere with the visibility of the box contents.

Figure 6:
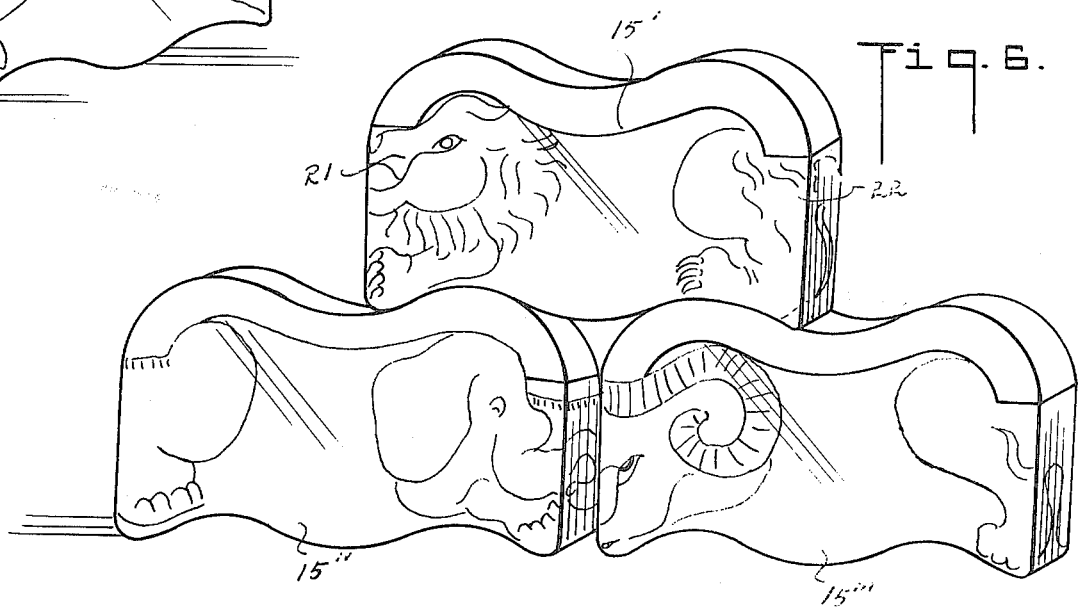
FIG. 6 illustrates three intercoupled boxes.

In FIG. 6, box 15', which is seated above a pair of boxes 15'' and 15''', has sheets 21 and 22 attached thereto to provide a play module that looks like a lion. Obviously, by means of such sheets or other decorative means, a box in accordance with the invention may be transformed into any four-legged animal. It will be seen that boxes 15'' and 15''' are placed in the ground in end-to-end relation, whereas the third box 15' intercouples the boxes therebelow by straddling the adjacent humps of boxes 15'' and 15''' are placed in the ground in end-to-end relation, whereas the third box 15' intercouples the boxes therebelow by straddling the adjacent humps of boxes 15'' and 15'''. The resultant three-module edifice is therefore stable.

Because of the humped box formation, a great number of module configurations are possible. Thus in FIG. 7, an acrobatic formation is shown in which the lowest tier is formed by box $15_4$, the intermediate tier by a pair of boxes $15_2$ and $15_3$, and the top tier by a box $15_1$ which straddles the intermediate boxes and prevents them from falling off the lowest tier. Alternatively, one may by means of boxes $15_5$, $15_6$ and $15_7$, as shown in FIG. 8, form an arch in which boxes $15_5$ and $15_6$ form the columns, and box $15_7$, the crosspiece.

While there has been shown and described a preferred embodiment of a box--play module in accordance with the present invention, it will be appreciated that many changes and modifications may be made therein without, however, departing from the essential spirit thereof.

I claim:

1. A box usable in conjunction with a dispenser unit having channels for accommodating a plurality of such boxes in stacked relation, which boxes when withdrawn from the unit functioning as play modules, said box having a four-legged animal-like abstract form and including an upper side wall having a double-hump sinuous wave formation to define the head and hindquarter portion of an animal and a lower side wall having a complementary single hump sinuous wave formation, to define the fore and hind legs of the animal whereby when one box is stacked on the other with the single hump of the upper box nesting between the double humps of the lower box, the boxes intermesh, and when a pair of boxes are placed in end-to-end relation, they may be intercoupled by a third box whose lower wall single hump is seated on and straddles the adjacent humps on the upper walls of the pair below, said box having a hinged hatch covering an opening in the upper side wall and conforming to the curvature of said wall.

2. A box as set forth in claim 1, wherein said box has straight end walls which merge with the side walls to form rounded corners.

3. A box as set forth in claim 1, wherein said box is fabricated of transparent plastic material.

4. A box as set forth in claim 1, wherein the ends of the box have printed sheets attached thereon, one sheet presenting the fore part of a four-legged animal and the other sheet the rear part of the animal.

5. A box as set forth in claim 4, wherein said sheet is of transparent film material.

* * * * *